US005773400A

United States Patent [19]

Baillely et al.

[11] Patent Number: 5,773,400

[45] Date of Patent: Jun. 30, 1998

[54] NIL-PHOSPHATE GRANULAR DETERGENT COMPOSITIONS WHICH CONTAIN PERCARBONATE AND SULFATE PARTICLES

[75] Inventors: Gerard Marcel Baillely; Richard Timothy Hartshorn, both of Newcastle upon Tyne, Great Britain

[73] Assignee: The Procter & Gamble Company, Cincinnati, Ohio

[21] Appl. No.: 648,112

[22] PCT Filed: Dec. 1, 1994

[86] PCT No.: PCT/US94/13700

§ 371 Date: May 21, 1996

§ 102(e) Date: May 21, 1996

[87] PCT Pub. No.: WO95/16018

PCT Pub. Date: Jun. 15, 1995

[30] Foreign Application Priority Data

Dec. 10, 1993 [EP] European Pat. Off. ..... 93309961

[51] Int. Cl.[6] ..... C11D 3/04; C11D 3/395

[52] U.S. Cl. ..... 510/315; 510/309; 510/317; 510/349; 510/375; 510/377; 510/438; 510/441

[58] Field of Search ..... 510/309, 315, 510/317, 375, 377, 446, 492, 349, 438, 441

[56] References Cited

U.S. PATENT DOCUMENTS

| | | | |
|---|---|---|---|
| 3,963,634 | 6/1976 | Tachibana et al. | 510/375 |
| 3,979,318 | 9/1976 | Tokiwa et al. | 252/186.22 |
| 3,997,692 | 12/1976 | Lamberti | 427/215 |
| 4,526,698 | 7/1985 | Kuroda et al. | 510/306 |
| 5,454,982 | 10/1995 | Murch et al. | 510/321 |

FOREIGN PATENT DOCUMENTS

| | | | |
|---|---|---|---|
| WO 92/06163 | 4/1992 | WIPO | C11D 3/00 |

*Primary Examiner*—Paul Lieberman
*Assistant Examiner*—Caroline L. Dusheck
*Attorney, Agent, or Firm*—Ken K. Patel; Kim W. Zerby; Jacobus C. Rasser

[57] ABSTRACT

Stable granular detergent compositions with good flow and dispensing properties are prepared using percarbonate bleach and selected sulfate salts. Thus, particles comprising builders and surfactants are prepared separately from percarbonate bleach particles of defined particle size. Water-soluble sulfate particles having a defined size range and no more than 40 ppm iron and no more than 5 ppm copper are used in the compositions. The specified moisture content of the ingredients and overall compositions improves stability and flow/dispensing properties.

12 Claims, No Drawings

NIL-PHOSPHATE GRANULAR DETERGENT COMPOSITIONS WHICH CONTAIN PERCARBONATE AND SULFATE PARTICLES

TECHNICAL FIELD

The present invention relates to granular detergent compositions which contain a percarbonate bleach and which are formulated to provide not only good detergency and bleaching performance, but also improved storage stability and improved flowability and dispensing of the granules.

BACKGROUND OF THE INVENTION

The formulation of modem granular laundry detergents without the use of phosphate builders and under various constraints with respect to fabric safety and environmental effects is a substantial challenge. The formulator is faced with the need to provide detergent compositions which remove a wide variety of soils and stains from a wide variety of fabrics. Detergent compositions must function effectively over a wide range of wash temperatures. They must be storage-stable over a wide range of temperatures and humidities. Granular detergents should desirably be free-flowing and easily dispensed in automatic equipment. They must not suds too much nor too little. To be affordable, they must be formulated using economical, yet safe and effective, ingredients. Accordingly, there continues to be a substantial investment in the search for new and improved detergent compositions.

Inorganic bleaches such as percarbonate offer prospective advantages to the detergent formulator due to their inherent cleaning ability. Moreover, percarbonate bleaches offer prospective advantages over the commonly-used perborate bleach, inasmuch as they do not disadvantageously interact with important new surfactants such as the polyhydroxy fatty acid amides. In addition, there is now some indication that perborate bleach can sometimes undesirably complex with, and stabilize, "polyol" stains, such as the polyphenolic materials found in chocolate. Percarbonates do not suffer from this disadvantage. Moreover, if properly formulated, especially as disclosed herein, percarbonate can provide superior dispensing properties as compared with perborate. Unfortunately, percarbonates are not as stable as perborates; hence, their formulation in granular detergents can be problematic.

The present invention addresses the problems associated with the formulation of granular detergent compositions which contain percarbonate bleach and provides means for overcoming such problems. The present invention provides granular compositions with superior dispensing properties, superior fabric cleansing performance at both high and low washing temperatures (typically, 20° C. to 90° C.) and equal storage stability, as compared with granular compositions containing perborate bleach.

BACKGROUND ART

EP 451,893, U.S. Pat. No. 5,236,613, Japanese A4-227,693, Japanese 63-62442 and Japanese KOKOKU 61-16319 relate to percarbonate bleach.

SUMMARY OF THE INVENTION

The present invention encompasses granular detergent compositions (preferably nil-phosphate) with builder, surfactant and percarbonate bleach, characterized in that they comprise:

(a) from 10% to 85% by weight of composition particles which comprise:
  (i) from 5% to 80% by weight of particle of a member selected from the group consisting of zeolite builders, carbonate builders, silicate builders, or mixtures thereof;
  (ii) from 5% to 60% by weight of particle of a detersive surfactant, or mixtures of detersive surfactants;
  (iii) from 0% to 70% by weight of particle of a water-soluble inorganic sulfate salt, said sulfate salt being contaminated with no more than 60 ppm iron and no more than 5 ppm copper;
  (iv) when said water-soluble sulfate salt is present at a level of 1% or greater in said particle, from 0.3% to 15% by weight of a chelant;

(b) from 3% to 50% by weight of composition of percarbonate bleach particles having an average particle size in the range from 500 micrometers to 1000 micrometers, not more than 10% by weight of said percarbonate being particles smaller than 200 micrometers and not more than 10% by weight of said particles being larger than 1250 micrometers;

(c) from 5% to 35% by weight of composition of water-soluble sulfate particles, said particles being dry-blended with particles (a) and (b), said sulfate particles being contaminated with no more than 40 ppm ion and no more than 5 ppm copper, said sulfate particles having an average particle size in the range from 250 micrometers to 1400 micrometers, not more than 25% by weight of said sulfate particles being larger than 1000 micrometers and not more than 2% of said particles being smaller than 250 micrometers; and (d) optionally, adjunct ingredients.

In order to achieve optimal stability of the percarbonate, particle (a) should have a moisture content not exceeding 13%, most preferably less than 11%, by weight. In order to achieve good flowability and dispensing in automatic equipment, particle (a) should have a moisture content of at least 2%, by weight. If particle (a) is prepared by spray-drying, it preferably should have a moisture content of at least 7%, by weight.

Preferred compositions herein are those wherein particle (a) comprises a builder selected from the group consisting of zeolites A, P, MAP, X, Y or mixtures thereof, layered silicate builders, sodium carbonate builders, and mixtures thereof.

When particle (a) also comprises greater than 1% of an optional water-soluble sulfate component, it typically will also contain a chelant, preferably selected from the group consisting of phosphonate, amino carboxylate, and polycarboxylate chelants, and mixtures thereof, usually at levels of from 0.3% to 4.0% by weight in said particle.

For stability on storage, the particles of percarbonate bleach (b) may be coated, e.g., with a member selected from the group consisting of water-soluble carbonate, water-soluble sulfate, water-soluble citrate, dehydrated or partially hydrated zeolite, water-soluble surfactants, or mixtures thereof. Whether or not stabilized by such means, the particles of percarbonate bleach preferably have an average size in the range from 500 micrometers to 1,000 micrometers. For stability purposes, it is also preferred that percarbonate particles (b) have a moisture content not greater than 1%, more preferably not greater than 0.5%, by weight of said percarbonate particles.

In order to provide further stability to the percarbonate and the overall compositions, the particles of sulfate (c) contain less than 25 ppm, preferably less than 5 ppm, iron, and preferably have an average particle size in the range of 450 micrometers to 800 micrometers.

In a preferred mode, the moisture content of the overall compositions herein is not greater than 8% by weight.

Fully-formulated detergent compositions which additionally contain from 0.1% to 20% by weight of various adjunct ingredients such as those selected from the group consisting of bleach activators, enzymes, soil release agents, fabric softeners, dispersants, optical brighteners and mixtures thereof, are also provided by this invention.

All percentages, ratios and proportions herein are by weight, unless otherwise specified. All documents cited are incorporated herein by reference.

DETAILED DESCRIPTION OF THE INVENTION

Detergency Builders

Particle (a) herein contains various conventional builders, or, optionally, mixtures of builders. Such builders assist in controlling mineral hardness in wash liquors and to assist in the removal of particulate soils from fabrics.

Aluminosilicate (zeolite) builders are quite useful in particles (a) herein and such builders are of great importance in most currently marketed heavy duty granular detergent compositions. Aluminosilicate builders include those having the empirical formula:

$$M_z(zAlO_2.ySiO_2)$$

wherein M is sodium, potassium, ammonium or substituted ammonium, z is from about 0.5 to about 2; and y is 1; this material having a magnesium ion exchange capacity of at least about 50 milligram equivalents of $CaCO_3$ hardness per gram of anhydrous aluminosilicate. Preferred aluminosilicates are zeolite builders which have the formula:

$$Na_z[(AlO_2)_z(SiO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite X, Zeolite Y, and Zeolite MAP. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated (x=0–10) Zeolite A can also be used. Preferably, the aluminosilicate has a particle size of about 0.1–10 microns in diameter. Mixtures of zeolites with organic builders such as citrate are also useful.

Examples of silicate builders useful in particles (a) herein include the alkali metal silicates, particularly those having a $SiO_2$:$Na_2O$ ratio ("R") in the range 1.6:1 to 3.2:1 and especially layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems. Mixtures of silicates, especially layered silicates, with organic builders such as citrate are also useful.

Examples of carbonate builders are the alkaline earth and alkali metal carbonates as disclosed in German Patent Application No. 2,321,001 published on Nov. 15, 1973. Typical examples include calcite and sodium carbonate.

In addition to the foregoing zeolite, silicate or carbonate builders, the finished compositions herein can optionally also comprise from 2% to 20% of various organic detergent builders, including, but not restricted to, a wide variety of polycarboxylate compounds. Such builders can be dry-mixed with the overall compositions, or, less preferably, can be incorporated into particle (a). As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance due to their availability from renewable resources and their biodegradability. Citrates are often used in granular compositions in combination with zeolite and/or layered silicate builders. Oxydisuccinates are also useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

While not preferred, in those situations where phosphorus-based builders can be used, the various alkali metal phosphates such as the well-known sodium tripolyphosphates, sodium pyrophosphate and sodium orthophosphate can be used.

Detersive Surfactants

Particle (a) herein also contains various anionic surfactants, or, optionally, mixtures of anionics with nonionic, zwitterionic or semipolar surfactants.

Nonlimiting examples of surfactants useful herein include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3(CH_2)_y(CHOSO_3^-M^+)$ $CH_2CH_3$ where x and (y+1) are integers of at least about 7, preferably at least about 9, and M is a water-solubilizing cation, especially sodium, the $C_{10}$–$C_{18}$ alkyl alkoxy sulfates ("$AE_xS$"; especially EO 1–5 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxylpropoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. Other conventional useful surfactants are listed in standard texts.

Percarbonate Bleach

The percarbonate bleach employed herein is the conventional percarbonate material available from suppliers such as Solvay, FMC, Tokai Denka and others. If desired, and to provide additional stability on storage, the particles of percarbonate can be coated or "dusted" with various materials such as sodium citrate, sodium carbonate, sodium sulfate, water-soluble surfactants, and mixtures thereof. Thus, a stabilized percarbonate bleach can comprise 2.5% of a 2.5:1 sodium carbonate:sodium sulfate by weight, or can comprise 5% citrate.

Sulfate Salts

Particle (a) herein can optionally comprise a water-soluble sulfate salt, and component (c) herein also comprises particles of sulfate salts having the physical and chemical parameters disclosed hereinabove. Typical examples of such salts include sodium sulfate, magnesium sulfate and aluminum sulfate.

Chelating Agents

Particle (a) of detergent compositions herein may also optionally contain one or more iron and/or manganese chelating agents, especially when a sulfate salt is present in said particle (a). Alternatively, the overall compositions may comprise from about 0.1% to about 5% by weight of such chelants. Such chelating agents can be selected from the group consisting of amino carboxylates, amino phosphonates, polyfunctionally-substituted aromatic chelating agents and mixtures thereof, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetraacetates, N-hydroxyethylethylenediaminetriacetates, nitrilotriacetates, ethylenediamine tetraproprionates, triethylenetetraaminehexaacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at least low levels of total phosphorus are permitted in detergent compositions, and include ethylenediaminetetrakis (methylenephosphonates), nitrilotris (methylenephosphonates) and diethylenetriaminepentakis (methylenephosphonates) as DEQUEST ("DTPMP"). Preferably, these amino phosphonates do not contain alkyl or alkenyl groups with more than about 6 carbon atoms. HEDP, 1,hydroxyethane diphosphonate, is suitable and preferably combined with aminophosphonates or amino carboxylates for use herein.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] form, as described in U.S. Pat. No. 4,704,233, Nov. 3, 1987, to Hartman and Perkins.

Adjunct Ingredients

The compositions herein can optionally include one or more other detergent adjunct materials or other materials for assisting or enhancing cleaning performance, treatment of the substrate to be cleaned, or to modify the aesthetics of the detergent composition (e.g., perfumes, colorants, dyes, etc.). The following are illustrative, but nonlimiting, examples of such materials.

Enzymes

Enzymes can be included in the formulations herein for a wide variety of fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1%, by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Amylases include, for example, a-amylases described in British Patent Specification No. 1,296,839 (Novo), RAPIDASE, International Bio-Synthetics, Inc. and TERMAMYL, Novo Industries.

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832.

Suitable lipase enzymes for detergent usage include those produced by microorganisms of the Pseudomonas group, such as Pseudomonas stutzeri ATCC 19.154, as disclosed in British Patent 1,372,034. See also lipases in Japanese Patent Application 53-20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum*, e.g. *Chromobacter viscosum* var. *lipolyticum* NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases ex *Pseudomonas gladioli*. The LIPOLASE enzyme derived from *Humicola lanuginosa* and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19,1989, by O. Kirk, assigned to Novo Industries A/S.

A wide range of enzyme materials and means for their incorporation into synthetic detergent granules are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0,199,405, Application No. 86200586.5, published Oct. 29, 1986, Venegas. Enzyme stabilization systems are also described, for example, in U.S. Pat. No. 3,519,570.

Enzyme Stabilizers

The enzymes employed herein can be stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species: see Severson, U.S. Pat. No. 4,537,706. Typical detergents will comprise from about 1 to about 30, preferably from about 2 to about 20, more preferably from about 5 to about 15, and most preferably from about 8 to about 12, millimoles of calcium ion per kilo of finished composition. This can vary somewhat, depending on the amount of enzyme present and its response to the calcium or magnesium ions. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from about 0.05 to about 0.4 millimoles per kilo, is often also present in the composition due to calcium in the enzyme slurry and formula water. In granular detergent compositions the formulation may include a sufficient quantity of a water-soluble calcium ion source to provide such amounts in the laundry liquor. In the alternative, natural water hardness may suffice.

It is to be understood that the foregoing levels of calcium and/or magnesium ions are sufficient to provide enzyme stability. More calcium and/or magnesium ions can be added to the compositions to provide an additional measure of grease removal performance. Accordingly, the compositions herein may comprise from about 0.05% to about 2% by weight of a water-soluble source of calcium or magnesium ions, or both. The amount can vary, of course, with the amount and type of enzyme employed in the composition.

The compositions herein may also optionally, but preferably, contain various additional stabilizers, especially borate-type stabilizers. Typically, such stabilizers will be used at levels in the compositions from about 0.25% to about 10%, preferably from about 0.5% to about 5%, more preferably from about 0.75% to about 3%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

Bleach Activators

The detergent compositions herein may optionally contain bleaching agents or bleaching compositions containing a bleaching agent and one or more bleach activators. If present, the amount of bleach activators will typically be from about 0.1% to about 60%, more typically from about 0.5% to about 40% of the bleaching composition comprising the percarbonate bleaching agent-plus-bleach activator.

The percarbonates are preferably used in the presence of bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. Benzoyl caprolactam and benzoyloxybenzene sulfonate activators can also be used. See also U.S. Pat. No. 4,634,551 for other typical bleaches and activators useful herein.

Bleaching agents other than percarbonate bleaching agents are known in the art and can optionally also be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such photoactivated bleaches, especially sulfonated zinc phthalocyanine.

Polymeric Soil Release Agent

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably poly(vinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from 2 to about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

One type of soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another polymeric soil release agent is a polyester with repeat units of ethylene terephthalate units containing 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857, issued Oct. 27, 1987 to Gosselink.

Another polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink.

Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Still other polymeric soil release agents also include the soil release agents of U.S. Pat. No. 4,877,896, issued Oct. 31, 1989 to Maldonado et al, which discloses anionic, especially sulfoaroyl, end-capped terephthalate esters.

If utilized, soil release agents will generally comprise from about 0.01% to about 10.0%, by weight, of the detergent compositions herein, typically from about 0.1% to about 5%, preferably from about 0.2% to about 3.0%.

Clay Soil Removal/Antiredeposition Agents

The compositions of the present invention can also optionally contain water-soluble ethoxylated amines having clay soil removal and antiredeposition properties. Granular detergent compositions which contain such agents typically contain from about 0.01% to about 10.0% by weight of the water-soluble ethoxylated amines.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal/antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. Another type of preferred antiredeposition agent includes the carboxy methyl cellulose (CMC) materials. These materials are well known in the art.

Polymeric Dispersing Agents

Polymeric dispersing agents can advantageously be utilized at levels from about 0.1% to about 7%, by weight, in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/antiredeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 70,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982.

Another polymeric material which can be included is polyethylene glycol (PEG). PEG can exhibit dispersing agent performance as well as act as a clay soil removal/antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents (mol. wt. about 10,000) may also be used, especially in conjunction with zeolite builders.

Brightener

Any optical brighteners or other brightening or whitening agents known in the art which do not contain copper or iron species can optionally be incorporated at levels typically from about 0.05% to about 1.2%, by weight, into the detergent compositions herein. Commercial optical brighteners which may be useful in the present invention can be classified into subgroups which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Arctic White CC and Artic White CWD, available from Hilton-Davis, located in Italy; the 2-(4-styryl-phenyl)-2H-naphthol[1,2-d]triazoles; 4,4'-bis- (1,2,3-triazol-2-yl)-stilbenes; 4,4'-bis(styryl)bisphenyls; and the aminocoumarins. Specific examples of these brighteners include 4-methyl-7-diethyl- amino coumarin; 1,2-bis (-benzimidazol-2-yl)ethylene; 1,3-diphenylphrazolines; 2,5-bis(benzoxazol-2-yl)thiophene; 2-styryl-naphth-[1,2-d] oxazole; and 2-(stilbene4-yl)-2H-naphtho- [1,2-d]triazole. See also U.S. Pat. No. 3,646,015, issued Feb. 29, 1972 to Hamilton.

Suds Suppressors

Compounds for reducing or suppressing the formation of suds can be incorporated into the compositions of the present invention. Suds suppression can be of particular importance under conditions such as those found in European-style front loading laundry washing machines, or in the concentrated detergency process of U.S. Pat. Nos. 4,489,455 and 4,489,574, or when the detergent compositions herein optionally include a relatively high sudsing adjunct surfactant.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acids and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g. stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g. K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about −40° C. and about 5° C., and a minimum boiling point not less than about 110° C. (atmospheric pressure). It is also known to utilize waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed of fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al, and in U.S. Pat. No. 4,652,392, Baginski et al, issued Mar. 24, 1987.

An exemplary silicone based suds suppressor for use herein is a suds suppressing amount of a suds controlling agent consisting essentially of:

(i) polydimethylsiloxane fluid having a viscosity of from about 20 cs. to about 1500 cs. at 25° C.;

(ii) from about 5 to about 50 parts per 100 parts by weight of (i) of siloxane resin composed of $(CH_3)_3SiO_{1/2}$ units of $SiO_2$ units in a ratio of from $(CH_3)_3SiO_{1/2}$ units and to $SiO_2$ units of from about 0.6:1 to about 1.2:1; and (iii) from about 1 to about 20 parts per 100 parts by weight of (i) of a solid silica gel.

In the preferred silicone suds suppressor used herein, the solvent for a continuous phase is made up of certain polyethylene glycols or polyethylene-polypropylene glycol copolymers or mixtures thereof (preferred), and not polypropylene glycol. The primary silicone suds suppressor is branched/crosslinked and not linear.

To illustrate this point further, typical laundry detergent compositions with controlled suds will optionally comprise from about 0.001 to about 1, preferably from about 0.01 to about 0.7, most preferably from abut 0.05 to about 0.5, weight % of said silicone suds suppressor, which comprises (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than about 2 weight %; and without polypropylene glycol. Similar amounts can be used in granular compositions, gels, etc. See also U.S. Pat. Nos. 4,978,471, Starch, issued Dec. 18, 1990, and 4,983,316, Starch, issued Jan. 8, 1991, and U.S. Pat. Nos. 4,639,489 and 4,749.740, Aizawa et al at column 1, line 46 through column 4, line 35.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight %, preferably more than about 5 weight %.

The preferred solvent herein is polyethylene glycol having an average molecular weight of less than about 1,000, more preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount." By "suds suppressing amount" is meant that the formulator of the composition can select an amount of this suds controlling agent that will sufficiently control the suds to result in a low-sudsing laundry detergent for use in automatic laundry washing machines. The compositions herein will generally comprise from 0% to about 5% of suds suppressor. When utilized as suds suppressors, monocarboxylic fatty acids, and salts therein, will be present typically in amounts up to about 5%, by weight, of the detergent composition. Preferably, from about 0.5% to about 3% of fatty monocarboxylate suds suppressor is utilized. Silicone suds suppressors are typically utilized in amounts up to about 2.0%, by weight, of the detergent composition, although higher amounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

In addition to the foregoing ingredients, the compositions herein can also be used with a variety of other adjunct ingredients which provide still other benefits in various compositions within the scope of this invention. The following illustrates a variety of such adjunct ingredients, but is not intended to be limiting therein.

Fabric Softeners

Various through-the-wash fabric softeners, especially the impalpable smectite clays of U.S. Pat. No. 4,062,647, Storm and Nirschl, issued Dec. 13, 1977, as well as other softener clays known in the art, can optionally be used typically at levels of from about 0.5% to about 10% by weight in the present compositions to provide fabric softener benefits concurrently with fabric cleaning. Clay softeners can be used in combination with amine and cationic softeners, as disclosed, for example, in U.S. Pat. No. 4,375,416, Crisp et al, Mar. 1, 1983 and U.S. Pat. No. 4,291,071, Harris et al, issued Sep. 22, 1981. Mixtures of cellulase enzymes (e.g., CAREZYME, Novo) and clays are also useful as high-performance fabric softeners. Various cationic materials can be added to enhance static control.

Other Ingredients

A wide variety of other ingredients useful in detergent compositions can be included in the compositions herein, including other active ingredients, carriers, hydrotropes, processing aids, dyes or pigments, etc. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, soluble magnesium salts such as $MgCl_2$, $MgSO_4$, and the like, can be added at levels of, typically, 0.1%–2%, to provide additional sudsing and/or product stability, as noted hereinafter.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%–5% of $C_{13-15}$ ethoxylated alcohol EO(7) nonionic surfactant. Typically, the enzyme/surfactant solution is 2.5× the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents, including liquid laundry detergent compositions.

Manufacturing Equipment

Various means and equipment are available to prepare particle (a) for use in granular detergent compositions according to the present invention. (Particles [b] and [c] can be prepared by conventional grinding or agglomerating processes.) Current commercial practice in the field involves mixing the various ingredients in an aqueous medium (the so-called "crutcher" mix) followed by passage through a heated spray-drying tower to produce granular particles, such as (a), which often have a density less than about 550 g/l. If such low density particles are desired, spray-drying is an acceptable means for their preparation. If high density particles (above 550 g/l, preferably 650–900 g/l) are desired, and if spray-drying is used as part of the overall process herein, the resulting spray-dried particles can be further densified such as by using the means and equipment described hereinafter. In the alternative, the formulator can eliminate spray-drying by using mixing, densifying and granulating equipment that is commercially available. The following is a nonlimiting description of such equipment suitable for use herein.

High speed mixer/densifiers can be used in the present process to prepare high density particles. For example, the device marketed under the trademark "Lödige CB30" Recycler comprises a static cylindrical mixing drum having a central rotating shaft with mixing/cutting blades mounted thereon. In use, the ingredients for the overall detergent composition are introduced into the drum and the shaft/blade assembly is rotated at speeds in the range of 100–2500 rpm to provide thorough mixing/densification. Other such apparatus includes the devices marketed under the trademark "Shugi Granulator" and under the trademark "Drais K-TTP 80).

Depending on the degree of densification and/or agglomeration desired, a processing step involving further densification can be conducted. Equipment such as that marketed under the trademark "Lödige KM600 Mixer", also known as the "Lödige Ploughshare" can be used. Such equipment is typically operated at 40–160 rpm. Other useful equipment includes the device which is available under the trademark "Drais K-T 160". The Lodige CB or KM type equipment can be used by itself or sequentially, e.g., by using the CB for paste dispersion and the KM for agglomeration. Batch or continuous feed can be employed.

In yet another mode, particle (a) of this invention can be prepared using a fluidized bed mixer. In this method, the various ingredients are combined in an aqueous slurry and sprayed into a fluidized bed of particles comprising, for example, particles of a zeolite or layered silicate or carbonate builder to provide the particles (a). In an alternate mode, the slurry can be sprayed into a fluidized bed of zeolite or layered silicate particles, plus particles of a surfactant. In such a process, the first step may optionally include mixing of the slurry using a "Lödige CB30" or "Flexomix 160", available from Shugi. Fluidized bed or moving beds of the type available under the trademark "Escher Wyss can be used in such processes. Other types of granules manufacturing apparatus useful herein include the apparatus disclosed in U.S. Pat. No. 2,306,898, to G. L. Heller, Dec. 29, 1942.

Whatever the method employed, particles (a) are combined with percarbonate particles (b) and sulfate particles (c), conveniently by dry-blending. Any adjunct agents, perfumes, etc., can be admixed or sprayed onto the mixture of the three types of particles.

The final density of the particles and compositions herein can be measured by a variety of simple techniques, which typically involve dispensing a quantity of the granular material into a container of known volume, measuring the weight of material and reporting the density as grams/liter. Methods used herein allow the material to flow into the measuring container under gravity, and without pressure or other compaction in the measuring container. The density measurements should be run at room temperature. The granular material whose density is being measured should be at least 24 hours old and should be held at room temperature for 24 hours prior to testing. The relative humidity is not particularly critical, but should not be so high that the particles stick together. A relative humidity of 50% or less is convenient. Of course, any clumps in the material should be gently broken up prior to running the test. In one typical method, the sample of material is allowed to flow through a funnel mounted on a filling hopper and stand (#150; Seedburo Equipment Company, Chicago, Ill.) into an Ohaus cup of known volume and weight (#104; Seedburo). The top of the cup is positioned about 50 mm from the bottom of the funnel, and the cup is filled to overflowing. A spatula or other straight edge is then scraped over the top of the cup, without vibration or tapping, to level the material, thereby exactly and entirely filling the cup. The weight of material in the cup is then measured. Density can be reported as g/l or ounces/cubic inch. Repeat runs are made and reported as an average. Relative error is about 0.4%.

The detergent compositions herein will preferably be formulated such that, during use in aqueous cleaning operations, the wash water will have a pH of between about 6.5 and about 11, preferably between about 7.5 and about 10.5. Techniques for controlling pH at recommended usage levels include the use of buffers, alkalis, acids, etc., and are well known to those skilled in the art.

The following Examples illustrate compositions according to this invention.

EXAMPLE I

| Form/Ingredient | Percent* A | Percent* B | Percent* C |
|---|---|---|---|
| Spray-dried granule | | | |
| Zeolite A (1–10 micrometer) | 20.50 | 20.50 | — |
| Silicate 1.6R | 2.9 | — | — |
| Silicate 3.2R | — | 2.9 | — |
| DTPMP | 0.3 | 0.3 | — |
| Copolymer maleic/acrylic (mw 70,000) | 1.8 | 1.8 | — |
| Magnesium sulfate | 0.4 | 0.4 | — |
| Sodium sulfate | 7.7 | 8.6 | — |
| LAS | 5.9 | 0.0 | — |
| $C_{16/18}$AS | 2.5 | 0.0 | — |
| 45AS | 0.0 | 7.0 | — |
| 13/15AE3S | 0.0 | 0.5 | — |
| Moisture[1] | 5.0 | 5.0 | — |
| Agglomerate | | | |
| 14/15AS | | | 5.0 |
| 12/15AS | | | 2.0 |
| 12/15AE3S | | | 1.5 |
| Zeolite A (1–10 micrometer) | | | 13.0 |
| Copolymer maleic/acrylic acid (mw 70,000) | | | 4.0 |
| Sodium carbonate | | | 7.0 |
| Moisture | | | 2.0 |
| Dry blended | | | |
| Sodium sulfate** | 7.7 | 7.7 | 9.0 |
| Percarbonate*** | 15.0 | 15.0 | 18.0 |
| TAED | 5.0 | 5.0 | 5.0 |
| SKS6/citric acid/TAE80(71/27/2) | — | — | 14.0 |
| Na carbonate | 12.7 | 12.7 | 6.0 |
| Bicarbonate | | | 3.0 |
| Savinase (4.0KNPU/g) | 0.9 | 0.9 | 1.4 |

-continued

| Form/Ingredient | Percent* A | Percent* B | Percent* C |
|---|---|---|---|
| Spray on | | | |
| $C_{14-15}AE_7$ | 5.0 | 0.0 | 2.0 |
| $C_{12-15}AE_3$ | 0.0 | 4.0 | 3.0 |
| Balance/moisture/misc. | 100.0 | 100.0 | 100.0 |

*Percent by weight of final composition.
[1]Corresponds to 10.6% moisture in the spray-dried granule component, said component constituting 47% of the final composition.
**Percarbonate coated with 2.5% of a carbonate/sulfate mixture (2.5:1 weight ratio) having an activity of 13.25% (AvOx content), an average particle size of 600um.
***Na sulfate with 3 ppm iron, 1 ppm copper, 1% particles less than 250um, 10% particles less than 425um, 60% particles less than 600um, 70% particles below 850um, 90% particles less than 1000um.

The foregoing compositions exhibit acceptable stability of the percarbonate, i.e., typically less than about 15% decomposition, as measured in a simple storage test (28° C., sealed bottle, 6-weeks' storage).

In a modification of the foregoing, the stabilization benefits of the silicate are further improved by the addition of soluble magnesium salts such as $Mg\ Cl_2$ or $Mg\ SO_4$ to the spray-dried particles (a), conveniently in the crutcher mix. While not intending to be limited by theory, it is hypothesized that the Mg/silicate colloids which form in the crutcher would strongly scavenge heavy metal cations. Magnesium:silicate ratios as low as 0.2:3.0 are effective.

Moisture in the foregoing compositions can be measured by any conventional means. In a preferred, simple method, moisture is measured as moisture loss on heating. For example, a 2 gram sample of particles is loaded onto the weighing pan of a PM400 Mettler balance fitted with an LP16 infrared heater. The sample is heated at 160° C. for 20 minutes. The moisture level is displayed as a function of percent weight loss.

The dispensing properties of the foregoing granules can be measured as follows. The detergent granules are stored for 4 weeks in closed cartons at 90° F. (32° C.)/80% relative humidity. After storage, 150 g of the detergent granules are weighed into the main compartment of a HotPoint washing machine dispenser drawer. The drawer is preweighed. Water (20° C.) is flushed through the main compartment drawer at a rate of 2 liters/min. for 2 minutes. The excess water in the compartment is drained off and the drawer is reweighed. This experiment is repeated 6 times. The percent residue left in the drawer is expressed by the following formula. An acceptable level of residues is below 15%. The formulations according to this invention pass this test.

$$\frac{\%\ \text{residues} = \text{weight drawer} + \text{product after flushing} - \text{weight drawer}}{\text{weight product added}}$$

While the foregoing Examples illustrate the practice of the technology herein, it will be appreciated that simple modifications can be made without departing from the spirit and scope of the invention.

What is claimed is:

1. A nil-phosphate granular detergent composition comprising:

(a) from 10% to 85% by weight of the detergent composition of particles which comprise, by weight of particle:

(i) from 5% to 80% of a builder selected from the group consisting of zeolite builders, carbonate builders, silicate builders, and mixtures thereof;

(ii) from 5% to 60% of a detersive surfactant, or mixtures of detersive surfactants;

(iii) from 0% to 70% of a water-soluble sulfate salt, the sulfate salt being contaminated with no more than 60 ppm iron and no more than 5 ppm copper; and (iv) when the water-soluble sulfate salt is present at a level of 1% or greater in the particle, from 0.3% to 15% of a chelant;

(b) from 3% to 50% by weight of the detergent composition of percarbonate bleach particles having an average particle size in the range from 500 micrometers to 1000 micrometers, not more than 10% by weight of the percarbonate particles being smaller than 200 micrometers and not more than 10% by weight of the particles being larger than 1250 micrometers, wherein the percarbonate particles optionally include a coating, and further wherein the coating, if included, consists of water-soluble carbonates, water-soluble sulfates, water-soluble citrates, dehydrated or partially hydrated zeolites, water-soluble surfactants, or mixtures thereof;

(c) from 5% to 35% by weight of the detergent composition of particles consisting essentially of water-soluble sulfate, the sulfate particles being dry-blended with particles (a) and (b), the sulfate particles being contaminated with no more than 40 ppm iron and no more than 5 ppm copper, the sulfate particles having an average particle size in the range from 250 micrometers to 1400 micrometers, not more than 25% by weight of the sulfate particles being larger than 1000 micrometers and not more than 2% of the sulfate particles being smaller than 250 micrometers; and (d) optionally, adjunct ingredients.

2. A composition according to claim 1 wherein the moisture content of particle (a) ranges from 2% to 13%, by weight.

3. A composition according to claim 1 wherein particle (a) comprises a builder selected from the group consisting of zeolites A, P, MAP, X, Y and mixtures thereof, layered silicate builders, sodium carbonate builders, and mixtures thereof.

4. A composition according to claim 1 wherein particle (a) comprises greater than 1% of water-soluble sulfate component (c) and a chelant selected from the group consisting of phosphonate, amino carboxylate, and polycarboxylate chelants, and mixtures thereof.

5. A composition according to claim 1 wherein the particles of percarbonate bleach are coated and have an average size in the range from 500 micrometers to 1,000 micrometers.

6. A composition according to claim 1 wherein the particles of sulfate (c) contain less than 25 ppm iron.

7. A composition according to claim 6 wherein the sulfate particles (c) have an average particle size in the range of 450 micrometers to 800 micrometers.

8. A composition according to claim 1 wherein particle (b) has a moisture content not greater than 1% by weight of particle.

9. A composition according to claim 8 wherein the moisture content of the overall composition is not greater than 8% by weight.

10. A composition according to claim 6 wherein the particles of sulfate (c) contain less than 5 ppm iron.

11. A composition according to claim 1 wherein the chelant comprises an amino carboxylate, amino phosphonate, polyfunctionally-substituted aromatic chelating agent, or a mixture thereof.

12. A composition according to claim 1 wherein the particles of sulfate (c) consist essentially of sodium sulfate, magnesium sulfate or aluminum sulfate.

* * * * *